US007589274B2

(12) United States Patent
Funaki

(10) Patent No.: US 7,589,274 B2
(45) Date of Patent: Sep. 15, 2009

(54) ELECTRONIC MUSICAL INSTRUMENT AND TONE GENERATOR APPARATUS CONNECTABLE THERETO

(75) Inventor: Tomoyuki Funaki, Hamamatsu (JP)

(73) Assignee: Yamaha Corporation, Hamamatsu-Shi (JP)

( * ) Notice: Subject to any disclaimer, the term of this patent is extended or adjusted under 35 U.S.C. 154(b) by 709 days.

(21) Appl. No.: 11/215,192

(22) Filed: Aug. 29, 2005

(65) Prior Publication Data

US 2006/0054004 A1 Mar. 16, 2006

(30) Foreign Application Priority Data

Aug. 30, 2004 (JP) ..... 2004-249898

(51) Int. Cl.
*G10H 7/00* (2006.01)

(52) U.S. Cl. ..... 84/645

(58) Field of Classification Search ..... 84/645
See application file for complete search history.

(56) References Cited

U.S. PATENT DOCUMENTS

| | | | | |
|---|---|---|---|---|
| 5,345,035 | A * | 9/1994 | Yamada | 84/622 |
| 5,389,729 | A | 2/1995 | Hiramatsu | |
| 5,569,869 | A * | 10/1996 | Sone | 84/609 |
| 6,342,666 | B1 * | 1/2002 | Shutoh | 84/645 |
| 6,353,169 | B1 * | 3/2002 | Juszkiewicz et al. | 84/600 |
| 6,686,530 | B2 * | 2/2004 | Juszkiewicz et al. | 84/600 |
| 6,751,439 | B2 * | 6/2004 | Tice et al. | 434/350 |
| 6,838,609 | B2 | 1/2005 | Shimaya et al. | |
| 7,220,912 | B2 * | 5/2007 | Juszkiewicz et al. | 84/742 |
| 7,220,913 | B2 * | 5/2007 | Juszkiewicz et al. | 84/742 |
| 7,279,628 | B2 * | 10/2007 | Miyamoto et al. | 84/615 |
| 2003/0172797 | A1 * | 9/2003 | Juszkiewicz et al. | 84/601 |
| 2004/0103776 | A1 * | 6/2004 | Juszkiewicz et al. | 84/742 |
| 2004/0144241 | A1 * | 7/2004 | Juskiewicz et al. | 84/723 |
| 2004/0147301 | A1 | 7/2004 | Ikeya | |
| 2004/0168566 | A1 * | 9/2004 | Juszkiewicz et al. | 84/723 |

(Continued)

FOREIGN PATENT DOCUMENTS

JP 2001-356765 12/2001

(Continued)

OTHER PUBLICATIONS

Japanese Office Action, mailed December 2, 2008, for JP 2004-249898.

*Primary Examiner*—Jeffrey Donels
(74) *Attorney, Agent, or Firm*—Morrison & Foerster LLP

(57) ABSTRACT

Tone generation control signal and sound signal are communicated between an electronic musical instrument and an external apparatus, using a communication interface capable of bidirectionally communicating one or more types of signals via a common communication path in accordance with a common communication standard. Thus, where the electronic musical instrument does not have its own internal tone generator while the external apparatus has its own tone generator, a sound signal of a tone, corresponding to the tone generation control signal output from the electronic musical instrument, can be generated by the external apparatus and supplied to the electronic musical instrument, so that the electronic musical instrument can sound the sound signal. Also, information of the electronic musical instrument is transmitted to the external apparatus so that input and output paths to and from the tone generator of the external apparatus can be automatically set, via the communication interface tom, in correspondence with the electronic musical instrument.

14 Claims, 7 Drawing Sheets

U.S. PATENT DOCUMENTS

2004/0187673 A1* 9/2004 Stevenson ..... 84/737
2004/0261607 A1* 12/2004 Juszkiewicz et al. ..... 84/645
2005/0056141 A1* 3/2005 Uehara ..... 84/645
2005/0066797 A1* 3/2005 Miyamoto et al. ..... 84/615
2006/0037457 A1* 2/2006 Yanase et al. ..... 84/1
2006/0107825 A1* 5/2006 Hiratsuka ..... 84/622
2007/0089594 A1* 4/2007 Juszkiewicz et al. ..... 84/723
2007/0227344 A1* 10/2007 Ryle et al. ..... 84/723

FOREIGN PATENT DOCUMENTS

JP 2003-015645 1/2003
JP 2003-167578 6/2003
JP 2004-212582 7/2004

* cited by examiner

ELECTRONIC MUSICAL INSTRUMENT AND TONE GENERATOR APPARATUS CONNECTABLE THERETO

BACKGROUND OF THE INVENTION

The present invention relates to an electronic musical instrument which can externally output a tone generation control signal corresponding to operation on a performance operator unit and can generate and output an audible sound on the basis of a sound signal supplied from an external apparatus, as well as a tone generator apparatus which can generate a sound signal corresponding to a sound generation control signal supplied from outside the apparatus and externally output the thus-generated sound signal. More particularly, the present invention relates to a system which comprises an electronic musical instrument and tone generator apparatus interconnect via a single bidirectional communication network and in which apparatus or equipment setting concerning signal input and output paths to and from a tone generator are automatically set so that both tone generation control signals and sound signals can be appropriately communicated between the electronic musical instrument and tone generator apparatus.

Heretofore, electronic musical instruments have been known which include a performance operator unit for generating a predetermined tone generation control signal (e.g., MIDI signal) in response to user operation on the performance operator unit and sound or audibly generate a tone, via a sounding unit including a speaker, in accordance with a predetermined sound signal (e.g., audio signal) generated via a built-in (internal) tone generator apparatus in response to operation on the performance operator unit. Such electronic musical instruments have the tone generator apparatus fixedly installed therein, and, in some models, the installed tone generator apparatus is of a considerably low grade (or low spec). With recent technologies, it has become possible for an interested user to connect a separate, external tone generator apparatus to an electronic musical instrument, via a communication cable, so that the user can readily replace a low-grade (low-spec) tone generator apparatus with a high-grade (high-spec) tone generator apparatus and extend the functions of a tone generator apparatus. For example, a high-grade tone generator capable of generating high-quality sound signals may be implemented by a personal computer or dedicated tone generator module and then connected to an electronic musical instrument which is provided with only a performance operator unit for generating a predetermined tone generation control signal in response to user's operation and a sounding unit for audibly generating a tone in accordance with a predetermined sound signal. Generally, because personal computers and dedicated tone generator modules have superior processing capability and greater storage capacity as compared to electronic musical instruments, it is very easy to implement a high-grade (high-spec) tone generator, capable of high-quality sound signals, by means of a personal computer or dedicated tone generator module. Therefore, the user can obtain an electronic musical instrument equipped with a high-grade tone generator at relatively low cost, by connecting such a personal computer or dedicated tone generator module (constituting an external tone generator apparatus). Example arrangements for connecting an electronic musical instrument and a personal computer are disclosed in Japanese Patent Application Laid-open Publication No. 2001-356765.

In order to connected an electronic musical instrument and an external tone generator apparatus (i.e., personal computer, dedicated tone generator module or the like) in such a manner that various signals can be communicated (i.e., transmitted and received) between the two apparatus, communication cables corresponding to the types of the various signals to be communicated must be coupled to the respective communication interfaces of the musical instrument and tone generator apparatus per input and output. For example, a separate MIDI cable must be appropriately coupled to corresponding communication interfaces of the two apparatus in order to transmit a MIDI signal, i.e. a tone generation control signal, from the electronic musical instrument to the personal computer, and a separate RCA cable must be appropriately coupled to other corresponding communication interfaces of the two apparatus in order to transmit an audio signal, i.e. a sound signal, from the personal computer to the electronic musical instrument. Further, there are provided a plurality of input and output paths of signals to and from a tone generator section in the tone generator apparatus, and thus, unless the input and output paths of signals to and from the tone generator section are set properly, tone generation control signals received from the electronic musical instrument can not input to the tone generator section, and sound signals generated by the tone generator section can not be output to the electronic musical instrument. Heretofore, such apparatus (or equipment) setting has been performed manually by individual users. However, properly coupling a plurality of different communication cables, corresponding to various types of signals to be communicated, to the individual apparatus as noted above would involve complicated wiring operation, which tends to be very inconvenient. Also, because the users themselves have to perform the apparatus setting pertaining to the input and output paths of signals to and from the tone generator section each time it is necessary to do so, the apparatus setting tends to be very troublesome to the ordinary users and time-consuming, which would often make the users feel a great burden.

SUMMARY OF THE INVENTION

In view of the foregoing, it is an object of the present invention to provide an electronic musical instrument which allows a user to readily use a tone generator apparatus outside the electronic musical instrument. It is another object of the present invention to provide a tone generator apparatus which is located outside an electronic musical instrument and can readily provide a tone generator function to the electronic musical instrument. It is still another object of the present invention to provide a system where an electronic musical instrument and external tone generator apparatus can be removably connected with each other via a single bidirectional communication cable permitting communication of a tone generation control signal and sound signal between the electronic musical instrument and the tone generator apparatus, and which can automatically set apparatus setting concerning input and output paths of each signal to and from a tone generator of the external tone generator apparatus and can thereby eliminate a need for a user to perform complicated wiring and apparatus setting.

According one aspect of the present invention, there is provided an electronic musical instrument connectable with an external apparatus for communication therewith, the external apparatus being capable of establishing a plurality of input/output paths between the external apparatus and another apparatus, said electronic musical instrument comprising: a performance operation section that generates a tone generation control signal in response to performance operation; a sound output device that outputs an audible sound in accordance with a given sound signal; a communication interface capable of bidirectionally communicating one or more types of signals via a common communication path in accordance with a common communication standard; and a control section that performs control to transmit the tone generation control signal, generated by said performance operation section, to the external apparatus via said communication interface and receive a sound signal from the external apparatus via said communication interface, the received sound signal being delivered to said sound output device. Here, when the external apparatus has been connected to said electronic musical instrument via said communication interface, said control section transmits, to the external apparatus, predetermined information for setting signal input/output paths in the external apparatus.

According to the present invention, a tone generation control signal and sound signal are communicated between the electronic musical instrument and the external apparatus, using the communication interface, such as a USB interface, that is capable of bidirectionally communicating one or more types of signals via the common communication path in accordance with the common communication standard. Thus, where the electronic musical instrument does not have its own internal tone generator while the external apparatus has its own tone generator, a sound signal of a tone, corresponding to the tone generation control signal output from the electronic musical instrument, can be generated by the external apparatus and then supplied to the electronic musical instrument, so that the electronic musical instrument can sound the sound signal. Further, because one or more types of signals are communicated via the common communication path, the present invention can eliminate a need for the user to perform cumbersome wiring operation for, for example, individually connecting communication cables, corresponding to the types of various signals to be communicated, when the electronic musical instrument and external apparatus are to be interconnected for communication therebetween of the various signals.

According another aspect of the present invention, there is provided a tone generator apparatus connectable with a plurality of external apparatus for communication therewith, said tone generator apparatus being capable of establishing a plurality of input/output paths between said tone generator apparatus and another apparatus, said tone generator apparatus comprising: a tone generator section that generates a sound signal of a tone indicated by a tone generation control signal; a communication interface capable of bidirectionally communicating one or more types of signals via a common communication path in accordance with a common communication standard; a setting section that, when a given external apparatus has been connected to said tone generator apparatus via said communication interface, receives, from the given external apparatus, predetermined information for setting signal input/output paths in said tone generator apparatus and then automatically sets input and output paths between said tone generator section and said communication interface in accordance with the received predetermined information; and a control section that, in accordance with settings by said setting section, performs control to receive a tone generation control signal from the external apparatus via said communication interface and transmit the sound signal, generated by said tone generator section, to the external apparatus, the received tone generation control signal being delivered to said tone generator section.

Namely, when the external apparatus, such as an electronic musical instrument, has been connected to the tone generator apparatus via the communication interface, input and output paths between the tone generator section and the communication interface are automatically set in accordance with the predetermined information received from the electronic musical instrument so that signals can be input and output via the thus-set input and output paths; consequently, there is no need for the user to bother to perform apparatus setting concerning the input and output paths to and from the tone generator section. As a result, the present invention can significantly lessen the burden felt by the user.

According further aspect of the present invention, there is provided an electronic musical instrument system in which an electronic musical instrument and a tone generator apparatus are interconnected via an Internet, said electronic musical instrument comprising: a performance operator unit that generates a tone generation control signal in response to user operation; a control section that performs control to transmit the tone generation control signal, generated by said performance operator unit, to said tone generator apparatus connected to said electronic musical instrument via the Internet and receive a sound signal, corresponding to the tone generation control signal, from said tone generator apparatus; and a sound output section that audibly generates a tone in accordance with the sound signal received from said tone generator apparatus, and said tone generator apparatus comprising: a tone generator that generates a sound signal in accordance with the tone generation control signal; and a control section that performs control to receive the tone generation control signal from said electronic musical instrument connected to said tone generator apparatus via the Internet and transmit a sound signal, generated by said tone generator in accordance with the received tone generation control signal, to said electronic musical instrument.

The present invention may be constructed and implemented not only as the apparatus invention as discussed above but also as a method invention. Also, the present invention may be arranged and implemented as a software program for execution by a processor such as a computer or DSP, as well as a storage medium storing such a software program. Further, the processor used in the present invention may comprise a dedicated processor with dedicated logic built in hardware, not to mention a computer or other general-purpose type processor capable of running a desired software program.

The following will describe embodiments of the present invention, but it should be appreciated that the present invention is not limited to the described embodiments and various modifications of the invention are possible without departing from the basic principles. The scope of the present invention is therefore to be determined solely by the appended claims.

BRIEF DESCRIPTION OF THE DRAWINGS

For better understanding of the objects and other features of the present invention, its preferred embodiments will be described hereinbelow in greater detail with reference to the accompanying drawings, in which.

DETAILED DESCRIPTION OF THE INVENTION

Embodiment 1

Figure 1:
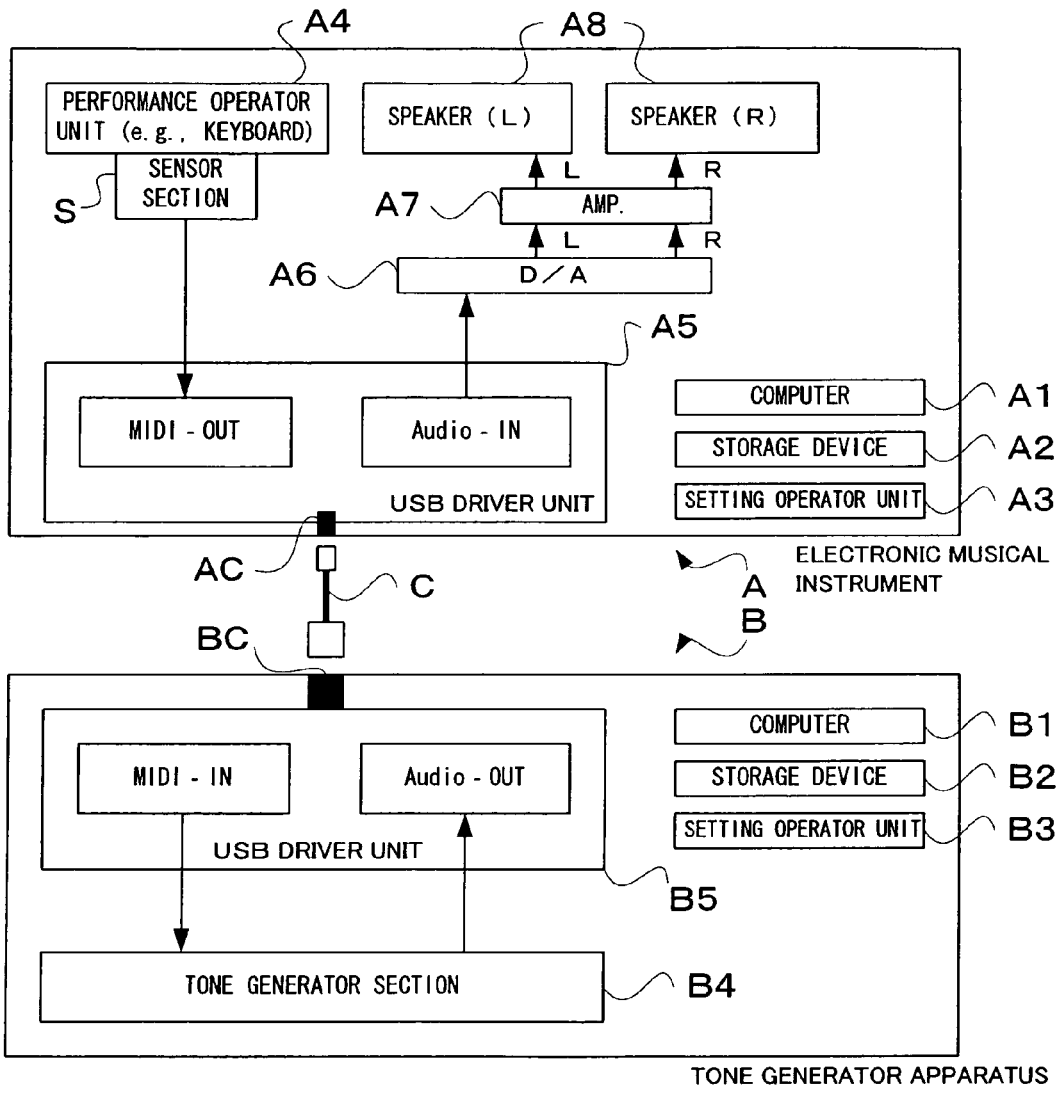
FIG. 1 is a block diagram showing an embodiment of a general setup of an electronic musical instrument system in which an electronic musical instrument and tone generator apparatus of the present invention are interconnected via a single bidirectional communication cable.

First, a description will be given about example construction of an electronic musical instrument and tone generator apparatus in accordance with the present invention. FIG. 1 is a block diagram showing an embodiment of a general setup of an electronic musical instrument system in which an electronic musical instrument and tone generator apparatus of the present invention are interconnected via a single bidirectional communication means. In the illustrated example of FIG. 1, a USB (acronym for Universal Serial Bus) is used as the single bidirectional communication means interconnecting the electronic musical instrument A and tone generator apparatus B.

In the illustrated example of FIG. 1, the electronic musical instrument A is in the form of a so-called "master keyboard" (also referred to as "keyboard controller") having no tone generator built or included therein. The electronic musical instrument A is a controller which is provided with only a performance operator unit and which has not only a tone generation control function for generating a tone generation control signal (MIDI signal in this case) but also a tone generation function for generating a tone by itself, namely, the electronic musical instrument A is an performance operator unit equipped with a sounding unit as will be later described. As seen in FIG. 1, the electronic musical instrument A includes the performance operator unit A4, sounding unit (including a D/A converter A6, amplifier A7 and left (L) and right (R) speakers A8), and a USB interface unit (including a USB driver unit A5 and USB connector AC). Because the electronic musical instrument A has no tone generator therein, it can not audibly generate or sound a tone via its sounding unit (A6-A8) as-is in response to user's operation on the performance operator unit A4. However, by being connected with an external tone generator apparatus B via a single USB cable C for bidirectional communication, the electronic musical instrument A can audibly generate a tone via its sounding unit (A6-A8) in response to operation on the performance operator unit A4, using the external tone generator apparatus B. Namely, although the electronic musical instrument A is not equipped with its own internal tone generator, it can audibly generate a tone via its sounding unit (A6-A8) by transmitting a MIDI signal, generated in response to operation on the performance operator unit A4, to the external tone generator apparatus B connected with the electronic musical instrument A via the USB cable C and then receiving a sound signal (audio signal in this case) generated via a tone generator section B4 of the external tone generator apparatus B, as will be later described in detail (with reference to FIG. 3).

Behavior of the entire electronic musical instrument A is controlled by a computer A1 including a CPU, ROM, RAM, etc. (not shown). Storage device A2 stores therein various control programs. such as the USB driver unit A5, to be executed by the computer A1. Here, the USB driver unit A5 is a communication-controlling software program that is used for electrically communicating predetermined signals with the external tone generator apparatus B via the USB cable C connected to a USB connector AC. Namely, hardware connection between the electronic musical instrument A and the tone generator apparatus B is implemented via the USB cable C and USB connector AC, and software connection between the electronic musical instrument A and the tone generator apparatus B, which communicate predetermined signals via the hardware connection, is implemented by the USB driver unit A5. In the instant embodiment, the USB driver unit A5 includes a MIDI-OUT driver for externally output a MIDI signal generated in response to operation on the performance operator unit A4 and an Audio-IN driver for inputting an audio signal from outside, and these drivers perform input/output control of corresponding signals. In the electronic musical instrument A, settings have been made in advance such that communication control is performed by the corresponding drivers in accordance with hardware construction of the communication interface used. The storage device A2 may be one using a hard disk (HD), a removable external storage medium, such as a flexible disk (FD), compact disk (CD), magneto optical disk (MO) or DVD (Digital Versatile Disk), or a semiconductor memory, such as a flash memory.

Setting operator unit A3 includes various operators, switches, etc. for controlling a volume etc. of each tone to be generated via one or more of the speakers A8. The performance operator unit A4 is, for example, in the form of a keyboard including a plurality of keys for selecting a pitch of each tone to be generated, and it also includes a sensor section S including key switches provided in corresponding relation to the keys. The performance operator unit A4 (e.g., keyboard) can be used not only as means for generating a MIDI signal in response to user's operation, but also as an input means for entering various settings. Needless to say, the performance operator unit A4 may be of any structural or operating type other than the keyboard type, such as a stringed instrument type, wind instrument type or percussion instrument type; namely, the electronic musical instrument A (i.e., performance operator unit equipped with the sounding unit) may be other than the keyboard type. Digital audio signal input from the external tone generator apparatus B is converted, via the D/A converter A6, into an analog audio signal, then amplified via the amplifier A7, and then sounded or audibly generated via the speaker 8A.

On the other hand, the external tone generator apparatus B is, for example, in the form of a personal computer or dedicated tone generator module, which includes the tone generator section B4. The tone generator apparatus B (personal computer or dedicated tone generator module) also includes a computer B1, storage device B2, setting operator unit B3, and a plurality of communication interfaces. The computer B1 controls behavior of the entire tone generator apparatus B. The setting operator unit B3 includes various operators, switches, etc. for, for example, selecting and setting a sound color (timbre), volume, effect, etc. The tone generator apparatus B includes, as the communication interfaces, a plurality of communication connectors (not shown), and the storage device B2 stores therein communication drivers corresponding to the communication connectors. For example, the tone generator apparatus B includes various communication connectors, such as a USB connector, IEEE1394 connector and RS-232C connector, and communication drivers corresponding to these communication connectors are stored in the storage device B2. In the tone generator apparatus B, communication control is performed by corresponding ones of the communication drivers in accordance with the type of the communication interface hardware-connected with the electronic musical instrument A. In the case where the hardware connection between the electronic musical instrument A and the tone generator apparatus B is implemented via the USB cable C and USB connector BC as seen in FIG. 1, software connection between the electronic musical instrument A and the tone generator apparatus B, communicating therebetween a predetermined signal via the hardware connection, is implemented by a USB driver unit B5. In the instant embodiment, the USB driver unit B5 includes a MIDI-IN driver for externally inputting a MIDI signal generated in response to operation on the performance operator unit A4 and an Audio-OUT driver for externally outputting an audio signal, and input/output control of corresponding signals is performed by these drivers.

Figure 2:
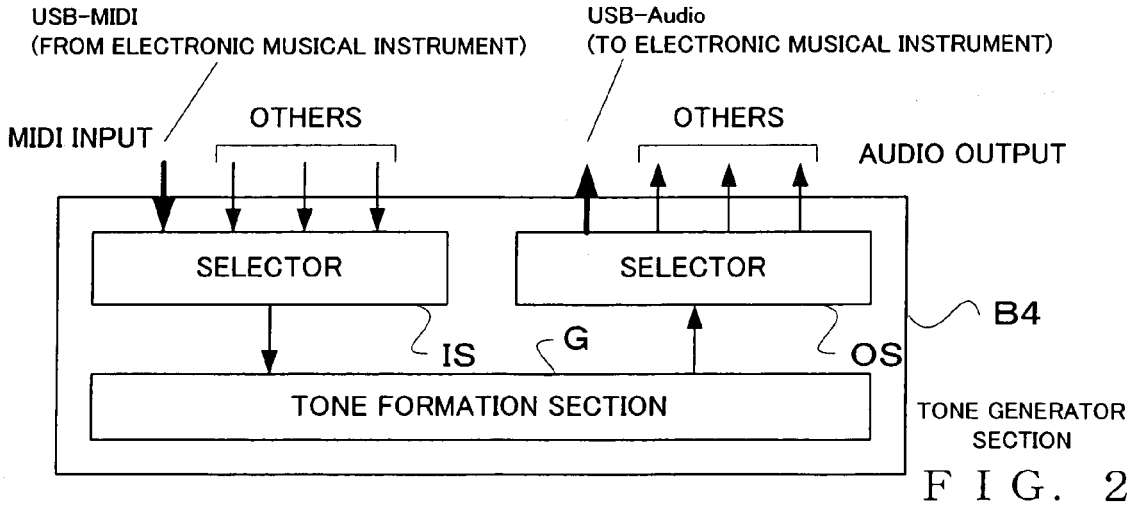
FIG. 2 is a block diagram showing an example specific hardware structure of a tone generator section in the tone generator apparatus of FIG. 1.

The tone generator section B4, which is capable of simultaneously generating audio signals in a plurality of channels, inputs a MIDI signal supplied via a predetermined signal input path to generate an audio signal on the basis of the input MIDI signal and also outputs the thus-generated audio signal via a predetermined signal output path. Details of the tone generator section B4 will be explained below with reference to FIG. 2. FIG. 2 is a block diagram showing an example specific hardware structure of the tone generator section B4 in the tone generator apparatus B. As illustrated in FIG. 2, the tone generator section B4 includes a selector IS for selecting a signal input path to be used from among a plurality of signal input paths, a selector OS for selecting a signal output path to be used from among a plurality of signal output paths, and a tone formation section G for generating an audio signal on the basis of a MIDI signal. The numbers and types of the input and output paths of signals to and from the tone generator section B4 may vary depending on the numbers and types of hardware and software (e.g., communication drivers) set in the tone generator apparatus B. Examples of the MIDI signal input paths include a USB-MIDI path, other serial (e.g., IEEE1394) MIDI path, etc. Examples of the audio signal output paths include a USB-Audio path, built-in D/A converter, other serial (e.g., IEEE1394) path, etc.

The tone generator section B4 may employ any of various tone synthesis methods, such as the FM, PCM, physical model and formant synthesis. Also, the tone generator section B4 may be implemented by either dedicated hardware, or software processing executed by a computer. Example where the tone generator is implemented by software processing by a computer will be later described with reference to FIG. 8.

As noted earlier, the hardware connection between the electronic musical instrument A and the tone generator apparatus B is implemented by connecting the USB cable C to the respective USB connectors (AC and BC) of the two apparatus (i.e., electronic musical instrument A and tone generator apparatus B). There are provided a plurality of input and output paths of signals to and from the tone generator section B4 as noted above, and a MIDI signal received from the electronic musical instrument A can not be input to the tone generator section B4 and an audio signal generated by the tone generator section B4 can not be output to the electronic musical instrument A, unless the input and output paths of signals to and from the tone generator section B4 are set appropriately. Thus, in order to allow the electronic musical instrument A to audibly generate a tone using the tone generator section B4 of the external tone generator apparatus B, it is necessary to appropriately set the input and output paths of signals to and from the tone generator section B4, in accordance with each communication interface connected with the electronic musical instrument A. Because the electronic musical instrument A and the external tone generator apparatus B are interconnected via the USB means in the instant embodiment as shown in FIG. 1, setting of the input and output paths of signals to and from the tone generator section B4 is automatically performed so that the USB-MIDI path is used to input a MIDI signal generated in response to operation of the performance operator unit A4 of the electronic musical instrument A while the USB-Audio is used to output a generated audio signal to the electronic musical instrument A. Such automatic setting of the signal input and output paths is performed such that apparatus information can be received from the electronic musical instrument A once the tone generator apparatus B is connected via the communication interface to the electronic musical instrument A and thus signals can be communicated via between the electronic musical instrument A and the tone generator apparatus B in accordance with the received apparatus information (see FIG. 3 to be later detailed). As seen in FIG. 2, the automatic setting of the signal input and output paths is performed, in effect, by controlling the selector IS for selecting one of the signal input paths and the selector OS selecting one of the signal output paths. In this way, the tone generator apparatus B is allowed to generate a tone in response to operation on the performance operator unit A4 of the electronic musical instrument A, and the sounding devices (A6-A8) of the electronic musical instrument A is allowed to audibly generate the thus-generated tone.

Figure 3:
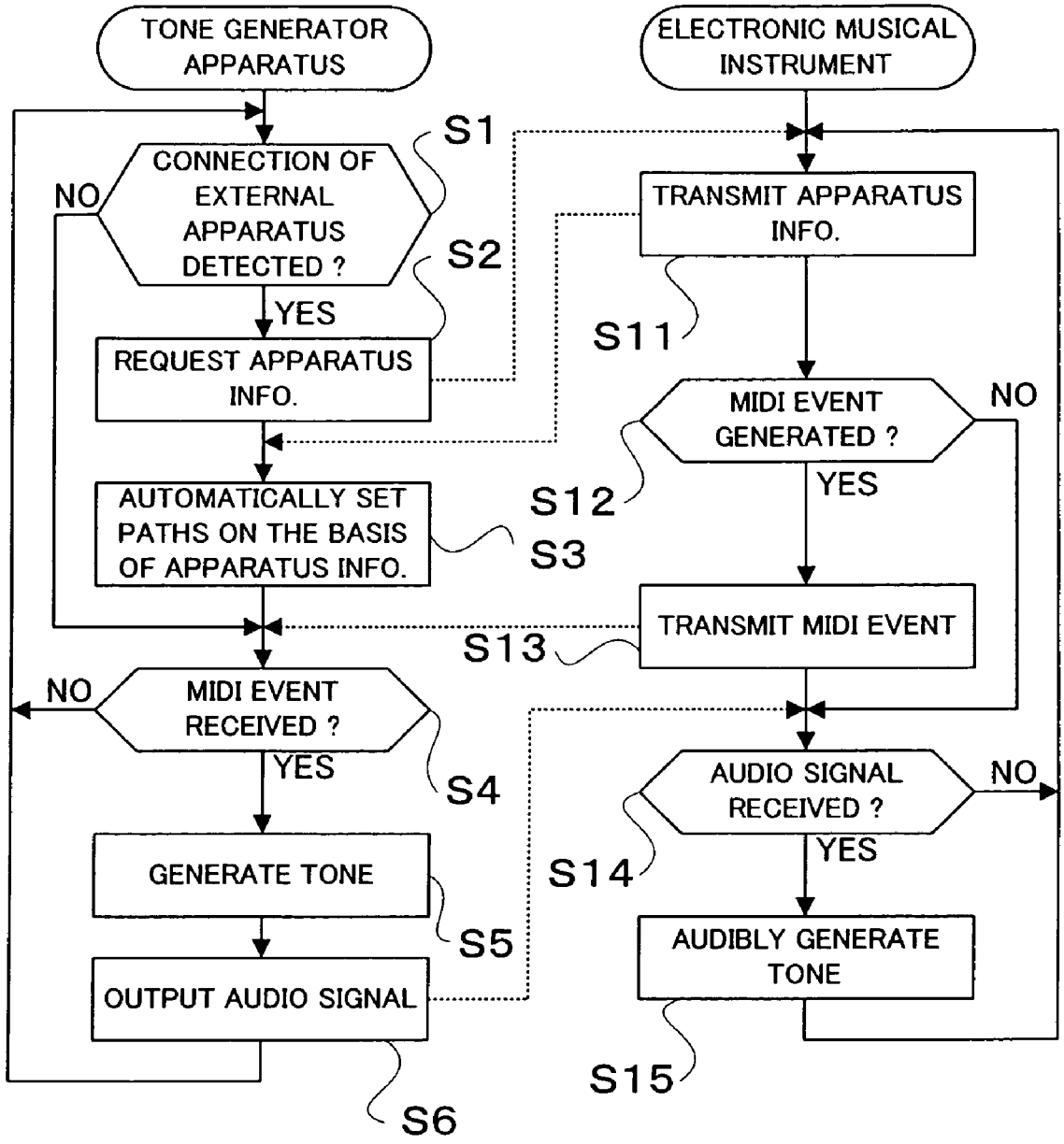
FIG. 3 is a flow chart of an embodiment of control processing carried out in the electronic musical instrument system of FIG. 1.

In the electronic musical instrument system of the present invention, the electronic musical instrument A can audibly generate a tone using the tone generator apparatus B4 of the tone generator apparatus B, by automatically setting the signal input and output paths to and from the tone generator apparatus B in accordance with the communication interface connecting the electronic musical instrument A. So, a description will hereinafter be described about control processing for allowing the electronic musical instrument A to audibly generate a tone using the tone generator apparatus B4 of the tone generator apparatus B. FIG. 3 is a flow chart of an embodiment of the control processing carried out in the electronic musical instrument system of FIG. 1. The control processing is started up and brought to an end in both of the electronic musical instrument A and tone generator apparatus B upon powering-on and powering-off, respectively, in the two apparatus.

First, at step S1, a determination is made, in the tone generator apparatus B, as to whether or not the electronic musical instrument A has been connected, as an apparatus external to the apparatus B, to any one of the plurality of communication interfaces (e.g., USB, IEEE1394) provided in the apparatus B If the electronic musical instrument A has been connected to any one of the plurality of communication interfaces (YES determination at step S1), the tone generator apparatus B requests the connected electronic musical instrument A to transmit apparatus information of the musical instrument A, at step S2. Upon receipt, from the tone generator apparatus B, of the request for the apparatus information, the electronic musical instrument A transmits the requested apparatus information to the tone generator apparatus B, at step S11. The apparatus information comprises pieces of information concerning, for example, the manufacturer's name, product name, model number, etc. of the electronic musical instrument A, which are stored in the storage device A2 of the electronic musical instrument A. Upon receipt of the apparatus information from the electronic musical instrument A, the tone generator apparatus B automatically sets the signal input and output paths to and from the tone generator section B4 on the basis of the received apparatus information, at step S3. As information concerning the signal input and output paths (i.e., input/output path setting information), predetermined information, including information of "communication interfaces", "types of input signals, "types of output signals" et., may be prestored, for each connectable apparatus, in the storage device B2, or information of the above-mentioned contents prestored in the storage device A2 of the electronic musical instrument A may be acquired from the musical instrument A along with the apparatus information. With such arrangements, each MIDI signal received from the electronic musical instrument A can be input to the tone generator section B4, and each audio signal generated by the tone generator section B4 can be output to the electronic musical instrument A; thus, the electronic musical instrument A can audibly generate a tone using the tone generator section B4 of the tone generator apparatus B.

As the performance operator unit A4 is operated in the electronic musical instrument A, MIDI events (MIDI signals) are generated in the electronic musical instrument A. The electronic musical instrument A constantly monitors, at step S12, whether any such MIDI event has been generated. If any MIDI event has been generated, i.e. if the performance operator unit A4 has been operated (YES determination at step S12), the generated MIDI event is transmitted to the tone generator apparatus B at step S13. The tone generator apparatus B constantly monitors, at step S4, whether any MIDI input has been received via any one of the already-set input paths. If any MIDI event has been received from the electronic musical instrument A (YES determination at step S4), the tone generator apparatus B generates a tone (i.e., audio signal) corresponding to the MIDI event at step S5, and transmits the audio signal to the electronic musical instrument A as an audio output via any one of the already-set output paths at step S6. The electronic musical instrument A also constantly monitors, at step S14, whether any audio signal has been received from the tone generator apparatus B. If any audio signal has been received from the tone generator apparatus B (YES determination at step S14), the electronic musical instrument A audibly generates a tone through the sounding devices, such as the speakers A8, on the basis of the received audio signal, at step S15. Note that the tone generator apparatus B may be arranged to generate sound signals of a plurality of channels and transmit these sound signals to the electronic musical instrument A on a time-divisional multiplexing basis.

As set forth above, the tone generator apparatus B acquires the apparatus information from the electronic musical instrument A, connected therewith via the communication interface capable of bidirectional communication, and automatically sets input and output paths of signals to and from the tone generator section B4 on the basis of the acquired apparatus information. Thus, the user does not have to wire a plurality of communication cables, corresponding to the types of various signals to be communicated between the electronic musical instrument A and the tone generator apparatus B, per input/output, each time the tone generator apparatus B is to be connected with the electronic musical instrument A. Further, the user itself does not have to perform apparatus setting concerning the input and output paths of signals to and from the tone generator section B4 whenever necessary, so that it is possible to lessen the feeling of burden of the user in using the external tone generator apparatus B from the electronic musical instrument A.

Note that, after the automatic setting of the signal input and output paths, any of the individual settings may be changed through operation by the user. Needless to say, the input and output paths is not performed where the electronic musical instrument A does not require such automatic setting or when information necessary for the automatic setting could not be acquired.

It is preferable that the color (timbre), volume, effect, etc. of tones to be generated be selected or set via the setting operator unit A3 provided in the electronic musical instrument A (i.e., performance operator unit equipped with the sounding unit).

Note that an external speaker (not shown) may be connected to the electronic musical instrument A via an RCA cable or the like so that a tone can be sounded via the external speaker in response to an analog-converted audio signal supplied from the amplifier A7 to the connected speaker.

Whereas the embodiment has been described above in relation to the case where a USB interface is used as the bidirectional communication interface that interconnects the electronic musical instrument A (i.e., performance operator unit equipped with the sounding unit) and the tone generator apparatus B (i.e., personal computer or tone generator module), the present invention is not so limited. The present invention may use any communication interface as long as it is based on a communication standard permitting simultaneous (bidirectional) reception and transmission (communication) of the MIDI signal and audio signal; the bidirectional communication may be performed in a wired or wireless manner. Further, it is preferable that the bidirectional communication interface (e.g., IEEE1394) used be based on a communication standard of a high signal transmission rate and low latency such that undesired delays, breaks or cutoffs of tones to be generated can be avoided or minimized.

Arrangements may be made such that the tone generator apparatus B (i.e., personal computer or tone generator module), is powered on in interlocked relation to powering-on of the electronic musical instrument A (performance operator unit equipped with the sounding unit). In the case where the electronic musical instrument A is constructed as a USB-based apparatus as in the above-described embodiment, a powering-on instruction can not be given voluntarily from the electronic musical instrument A (USB-based apparatus) to the tone generator apparatus B (USB host); thus, it is preferable that a powering-on instruction be given to the tone generator apparatus B (USB host) in accordance with a communication standard other than the USB communication standard. Alternatively, only a visual indication or sound may be generated for prompting powering-on of the tone generator apparatus B.

Embodiment 2

Figure 4:
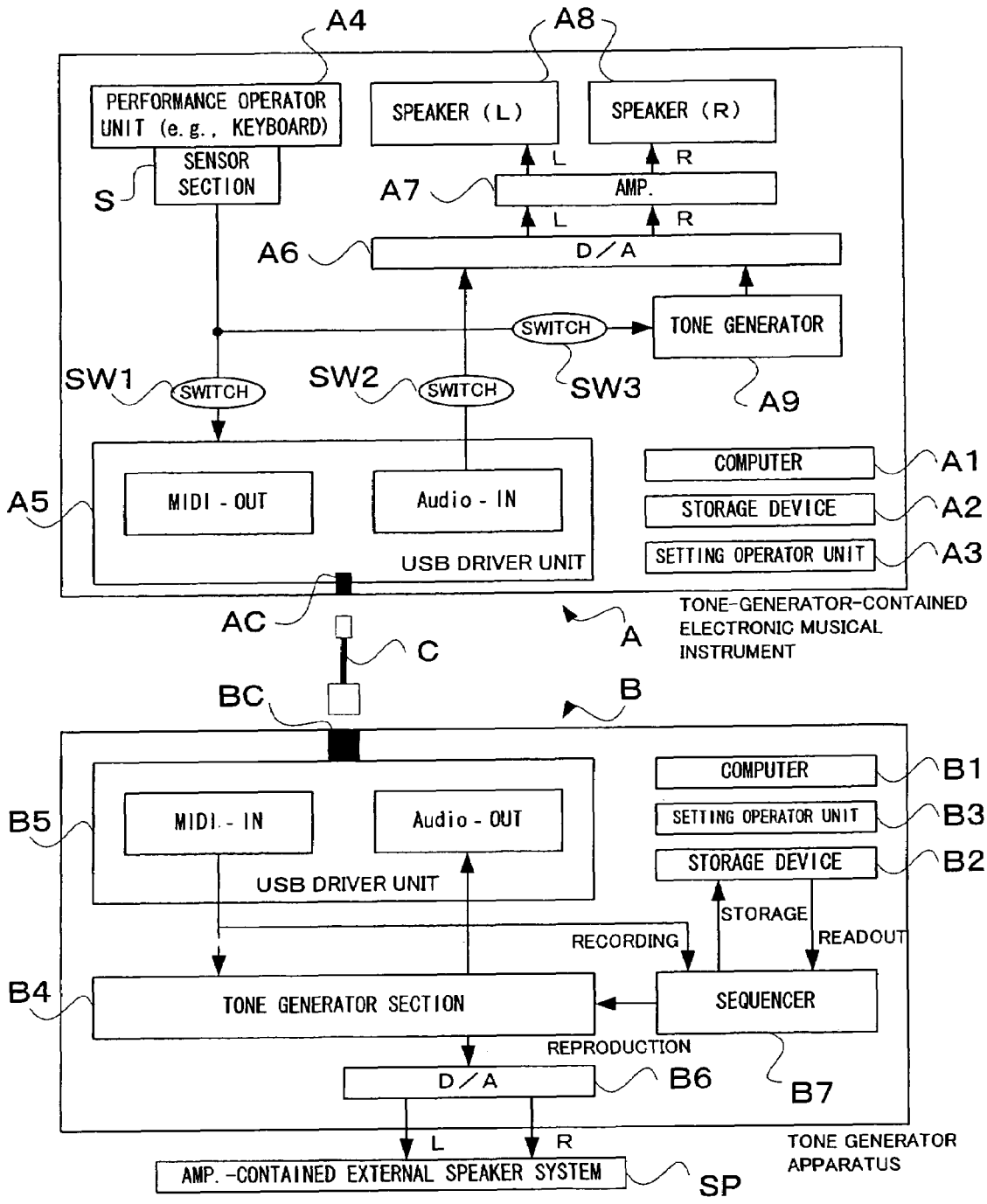
FIG. 4 is a block diagram showing an embodiment of a general setup of an electronic musical instrument system in which a tone-generator-contained electronic musical instrument and a sequencer-contained tone generator apparatus are interconnected via a single bidirectional communication interface.

Next, a description will be made about another embodiment where the electronic musical instrument A has its own tone generator incorporated or built therein and the tone generator apparatus B has both its own tone generator and a sequencer incorporated therein. Namely, in the instant embodiment, the electronic musical instrument A is capable of generating tones via its internal tone generator as well as the external tone generator apparatus B (i.e., via an extended tone generator), and the tone generator apparatus B is capable of generating tone generation control signals via its internal sequencer. These electronic musical instrument A and the tone generator apparatus B are interconnected via a bidirectional communication interface. FIG. 4 is a block diagram showing an embodiment of a general setup of an electronic musical instrument system in which the electronic musical instrument equipped with its internal tone generator and the tone generator apparatus equipped with its internal sequencer are interconnected via a single bidirectional communication interface. In the illustrated example of FIG. 4 too, a USB (Universal Serial Bus) is used as the single bidirectional communication means interconnecting the electronic musical instrument A and tone generator apparatus B. Description about the same elements and parts as in the example of FIG. 1 is omitted to facilitate understanding and avoid unnecessary duplication.

The electronic musical instrument A of FIG. 4 is a tone-generator-contained electronic musical instrument having its own tone generator A9 incorporated therein. The tone generator A9, which is capable of simultaneously generating audio signals in a plurality of channels, inputs a MIDI signal supplied via a predetermined signal input path to generate an audio signal on the basis of the input MIDI signal and also outputs the thus-generated audio signal via a predetermined signal output path. More specifically, the tone generator A9 generates an audio signal in accordance with a MIDI signal generated and delivered thereto in response to operation on the performance operator unit A4, on the basis of which a tone is audibly generated via the speakers A8 of the electronic musical instrument A. Namely, the electronic musical instrument A of FIG. 4 can generate tones on its own. Also, the electronic musical instrument A of FIG. 4 transmits a MIDI signal, generated in response to operation on the performance operator unit A4, to the external tone generator apparatus B connected therewith via the USB communication means, and a tone can be audibly generated, via the speakers A8 of the electronic musical instrument A, on the basis of an audio signal generated by the tone generator apparatus B. Namely, the electronic musical instrument A can generate tones through an extended tone generator function using its own internal tone generator A9 as well as the external tone generator apparatus B. Also, the electronic musical instrument A may only transmit a MIDI signal, generated in response to operation on the performance operator unit A4, to the external tone generator apparatus B USB-connected therewith, so as to cause a tone to be audibly generated via an external speaker system SP of the tone generator apparatus B; namely, in this case, the electronic musical instrument A can also be used as a mere master keyboard (keyboard controller) for controlling a tone to be audibly generated by the external tone generator apparatus B.

Figure 5:
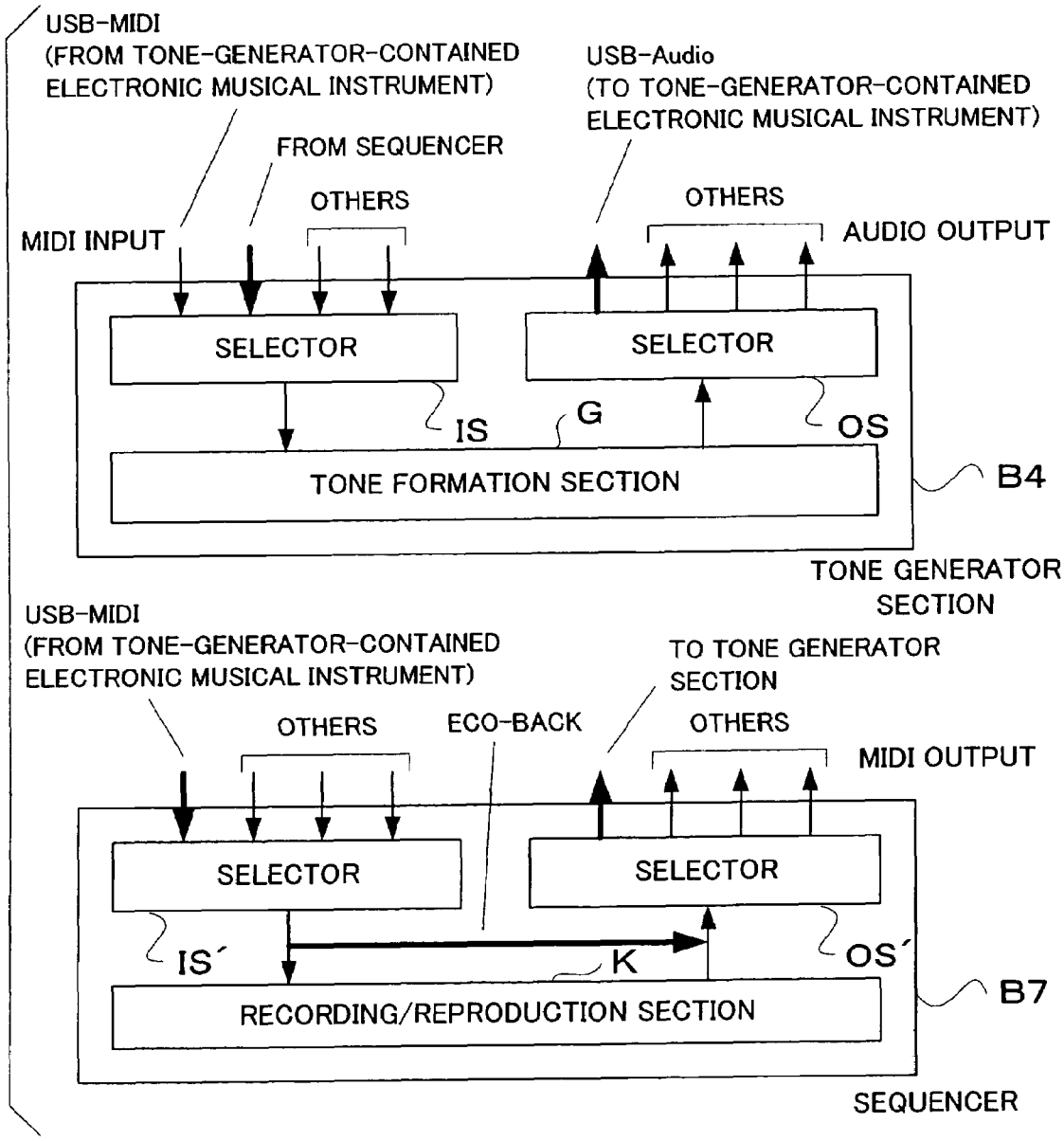
FIG. 5 is a block diagram showing example general hardware arrangements of a tone generator section and sequencer in the sequencer-contained tone generator apparatus shown in FIG. 4.

On the other hand, the tone generator apparatus B of FIG. 4 is a sequencer-contained tone generator apparatus having not only the tone generator section B4 but also the sequencer B7 incorporated therein. With the amplifier-contained external speaker system SP coupled to the tone generator apparatus B, an audio signal generated by the tone generator section B4 can be sent via a D/A converter B6 to the external speaker system SP so that a tone can be audibly generated from the speaker system SP on the basis of the audio signal. The sequencer B7 stores, into its storage device B2, each MIDI signal externally input via the USB interface unit (e.g., USB driver unit B5) ("audio recording" and "audio storage"). When an echo-back function is ON, the input MIDI signal is sent as-is to the tone generator section B4 so that a tone can be generated on the basis of the input MIDI signal. Also, by the sequencer B7 reading out any one of the MIDI signals stored in the storage device B2 ("readout") and delivering the readout MIDI signal to the tone generator section B4 ("reproduction"), the tone generator apparatus B can audibly generate a tone on the basis of the read-out MIDI signal. Thus, with the sequencer-contained tone generator apparatus B having not only the tone generator section B4 but also the sequencer B7 incorporated or built therein, it is necessary to perform apparatus setting for input and output paths of signals to and from not only the tone generator section B4 but also the sequencer B7. FIG. 5 is a block diagram showing example general hardware setups of the tone generator section B4 and sequencer B7 in the sequencer-contained tone generator apparatus B shown in FIG. 4.

As seen in FIG. 5, the sequencer B7 in the tone generator apparatus B includes a selector IS' for selecting a signal input path to be used from among a plurality of signal input paths, a selector OS' for selecting a signal output path to be used from among a plurality of signal output paths, and a recording/reproduction section K for storing an input MIDI signal into a not-shown storage device and reading out a MIDI signal from the storage device. The numbers and types of these input and output paths to and from the sequencer B7 may vary depending on the numbers and types of hardware and software (communication drivers) set in the tone generator apparatus B. For instance, examples of the input paths for MIDI signals include a USB-MIDI path, other serial (e.g., IEEE1394) MIDI path, etc., while examples of the output paths for MIDI signals include the tone generator section B4, other serial (e.g., IEEE1394) MIDI path, etc. The sequencer B7 also includes an echo-back path for outputting an input MIDI signal as-is.

The tone generator section B4, on the other hand, includes a selector IS for selecting a signal input path to be used from among a plurality of signal input paths, a selector OS for selecting a signal output path to be used from among a plurality of signal output paths, and a tone generation section G for generating an audio signal on the basis of a MIDI signal. The numbers and types of these input and output paths to and from the tone generator apparatus B may vary depending on the numbers and types of the hardware and software (communication drivers) set in the tone generator apparatus B. For instance, examples of the input paths for MIDI signals include a USB-MIDI path, serial (e.g., IEEE1394) MIDI path, sequencer, etc., while examples of the output paths for MIDI signals include a USB-Audio oath, built-in D/A converter, serial (e.g., IEEE1394) path, etc. Namely, the tone generator section B4 and the sequencer 7 include the signal input and output paths for inputting a MIDI signal, output from the sequencer 7, to the tone generator section B4.

In the electronic musical instrument system of FIG. 4, there are provided a function for allowing the electronic musical instrument A to generate a tone on its own (Mode 1: local-on), a function for allowing the electronic musical instrument A to generate a tone using the external tone generator apparatus B in order to extend the tone generator A9 provided in the instrument A (Mode 2: local-off and echo-back-on), and a function for controlling a tone to be audibly generated by the external tone generator apparatus B (Mode 3: local-off and echo-back-off). Any desired one of these functions or modes can be selected and set by a combination of ON/OFF states of predetermined switches (SW1-SW3). For example, Mode 1 can be set when the switches SW1 and SW2 are OFF and the switch SW3 is ON, Mode 2 can be set when the switches SW1 and SW2 are ON and the switch SW3 is OFF, and Mode 3 can be set when the switch SW1 is ON and the switches SW2 and SW3 are OFF. In accordance with such mode settings, control is performed, for example, as to whether or not a tone should be audibly generated on the basis of an audio signal generated by the tone generator A9 of the electronic musical instrument A, as to whether or not an audio signal should be generated on the basis of a MIDI signal generated by the sequencer of the tone generator apparatus B, and so on. Whereas the apparatus setting concerning the local-on/off and echo-back-on/off in the electronic musical instrument A is performed via the above-mentioned switches SW1-SW3, i.e., via manual setting operation by the user, the apparatus setting concerning the signal input and output paths to and from the tone generator section B4 and sequencer B7 in the tone generator apparatus B is performed automatically.

Figure 6:
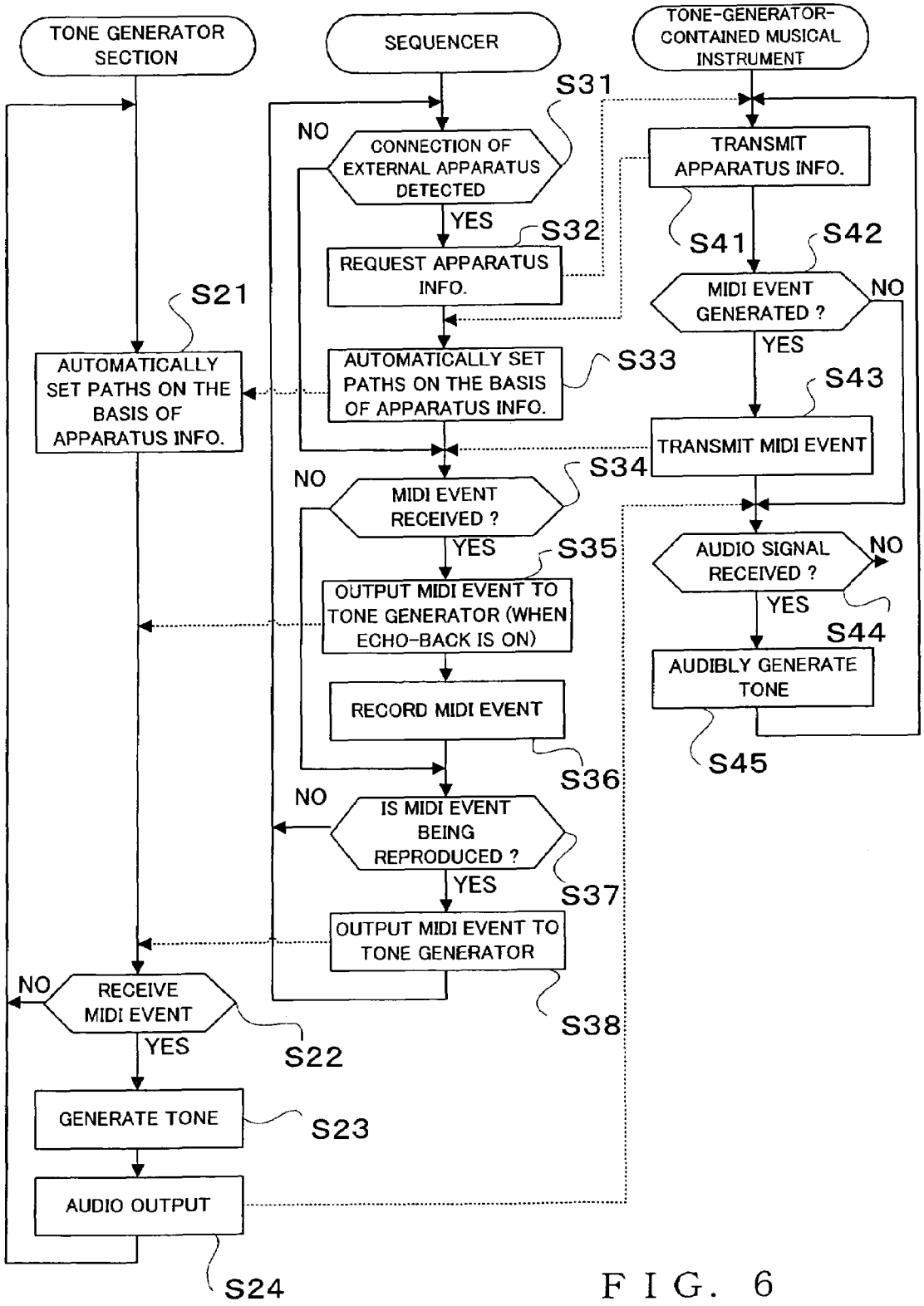
FIG. 6 is a flow chart showing an embodiment of control processing performed in the electronic musical instrument system shown in FIG. 4.

By automatically setting the signal input and output paths to and from the tone generator section B4 and sequencer B7 in accordance with the communication interface used, the embodiment of the present invention allows the electronic musical instrument A to audibly generate tones using the tone generator section B4 and sequencer B7 of the tone generator apparatus B. So, the following paragraphs describe control processing for audibly generating tones through the electronic musical instrument A using the tone generator apparatus B, with reference to FIG. 6. FIG. 6 is a flow chart showing an embodiment of the control processing performed in the electronic musical instrument system shown in FIG. 4. However, to facilitate understanding, a set of operations performed in the tone generator section B4 and a set of operations performed in the sequencer B7 are shown separately in FIG. 6.

First, at step S31, the sequencer B7 makes a determination as to whether the electronic musical instrument A has been connected, as an external apparatus, to any of the plurality of communication interfaces (e.g., IEEE1394) provided in the sequencer B7. If the electronic musical instrument A has been connected to any of the plurality of communication interfaces (YES determination at step S31), the sequencer B7 requests the connected electronic musical instrument A to transmit apparatus information of the musical instrument A, at step S32. Upon receipt, from the tone generator apparatus B, of a signal requesting the apparatus information, the electronic musical instrument A transmits the requested apparatus information to the tone generator apparatus B, at step S41. Upon receipt of the apparatus information from the electronic musical instrument A, the sequencer B7 automatically sets the signal input and output paths to and from the sequencer B7 on the basis of the received apparatus information and further delivers the received apparatus information to the tone generator section B4, at step S33. Upon receipt of the apparatus information from the sequencer B7, the tone generator section B4 automatically sets the signal input and output paths to and from the tone generator section B4 on the basis of the received apparatus information, at step S21.

As the performance operator unit A4 is performed in the electronic musical instrument A, MIDI events (MIDI signals) corresponding to the operation are generated in the electronic musical instrument A. The electronic musical instrument A constantly monitors, at step S42, whether any such MIDI event has been generated. If any MIDI event has been generated, i.e. if the performance operator unit A4 has been operated (YES determination at step S42), the generated MIDI event is transmitted to the sequencer B7 at step S43. The sequencer B7 constantly monitors, at step S34, whether any MIDI input has been received via any one of the already-set input paths, i.e. whether any MIDI event has been received from the electronic musical instrument A. If any MIDI event has been received from the electronic musical instrument A (YES determination at step S34), the sequencer B7 outputs the MIDI event to the tone generator apparatus B, at step S35; however, this operation is carried out only when the echo-back setting is ON. At step S36, the received MIDI event is recorded into the storage devices B2. If any one of the MIDI events recorded in the storage devices B2 is being currently reproduced (YES determination at step S37), that MIDI event is output to the tone generator section B4, at step S38. If any MIDI event has been received (YES determination at step S22), the tone generator section B4 generates a tone (i.e., audio signal) corresponding to the received MIDI event at step S23, and transmits the audio signal to the electronic musical instrument A as an audio output via any one of the already-set output paths at step S24. The electronic musical instrument A also constantly monitors, at step S44, whether any audio signal has been received from the tone generator apparatus B (more specifically, tone generator section B4). If any audio signal has been received from the tone generator section B4 (YES determination at step S44), the electronic musical instrument A audibly generates a tone through the sounding devices, such as the speakers A8, on the basis of the received audio signal, at step S45.

Namely, in the case where the electronic musical instrument A has its own tone generator A9 incorporated therein and the tone generator apparatus B has the sequencer B7, which generates MIDI signals, incorporated therein, the signal input and output paths to and from the tone generator section B4 etc. are automatically set in accordance with settings in the electronic musical instrument A, such as use/non-use (local-on/local-off) of the tone generator A9, in response to operation of the switches SW1-SW3 (i.e., mode setting) in the electronic musical instrument A. Thus, the user can cause tones to be appropriately audibly generated via the sounding devices (A6-A8) of the electronic musical instrument A, without having to perform cumbersome apparatus setting.

The electronic musical instrument A (i.e., performance operator unit equipped with the sounding unit) may be automatically set to the local-off state or mode so as not to use the internal tone generator A9 (namely, Mode 2 or Mode 3 may be automatically set), upon detecting that the instrument A has been connected to, or made communicatable with, the tone generator apparatus B (personal computer or tone generator module). Further, when the communication with the tone generator apparatus B is not permitted, the electronic musical instrument A may be automatically set to the local-on state or mode so as to use the internal tone generator A9 (namely, Mode 1 may be automatically set). Further, an instruction for performing these control may be given from the tone generator apparatus B (personal computer or tone generator module) to the electronic musical instrument A (i.e., performance operator unit equipped with the sounding unit).

If, in the embodiment of FIG. 4, there are provided two MIDI inputs to the tone generator section B4 of the tone generator apparatus B (i.e., the tone generator section B4 is a multi-port tone generator), tones may be audibly generated in accordance with both 1) a MIDI signal externally input from the electronic musical instrument A and then sent directly to the tone generator section B4 (as indicated by a broken line in FIG. 4) and 2) a MIDI signal sent from the sequencer B7.

EXAMPLE 3

Figure 7:
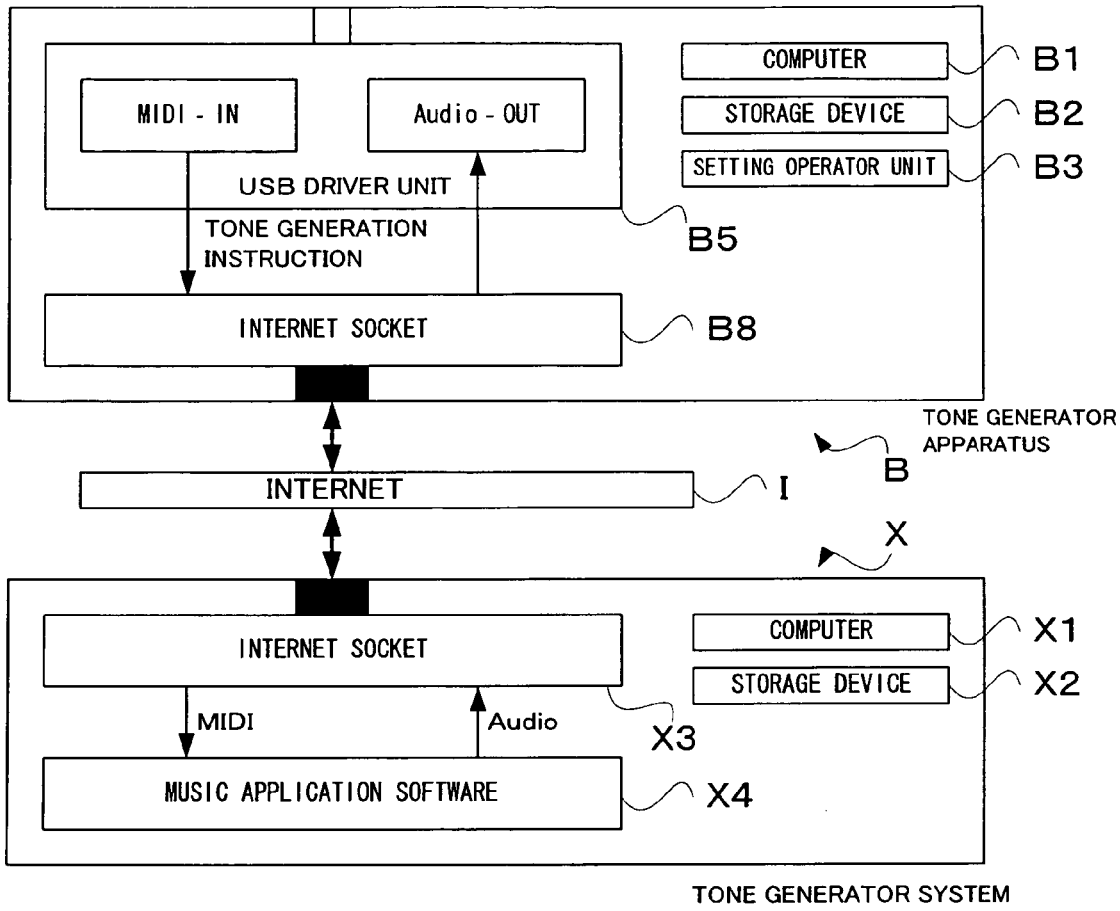
FIG. 7 is a block diagram showing an embodiment of a general setup of a tone generator system using the Internet.

Whereas each of the embodiments has been described above in relation to the case where an audio signal is generated by the tone generator section B4 incorporated in the tone generator apparatus B, the present invention is not so limited; for example, the tone generator apparatus B may also generate an audio signal using an external tone generator, as will be described below in relation to a tone generator system using the Internet. FIG. 7 is a block diagram showing an embodiment of a general setup of the tone generator system using the Internet.

As seen in FIG. 7, the tone generator apparatus B has an Internet socket B8, via which it is connectable to the Internet for communication therewith of various signals. To the Internet is also connected a tone generator system X for generating an audio signal on the basis of a MIDI signal in accordance with tone generator application software X4. Thus, even where the tone generator apparatus B includes no tone generator section, an audio signal can be generated by the tone generator apparatus B just transmitting a MIDI signal to the tone generator system X. Thus, using the connection to the Internet via the tone generator apparatus B (in this case, the tone generator system X is implemented primarily by a personal computer or the like for which constant connection to the Internet has been getting more and more common these days), the tone generator apparatus B can cause the tone generator system X on the Internet to generate an audio signal based on a MIDI signal. As a result, the user is advantageously allowed to readily use the latest tone generator apparatus, without paying an extra cost for connection to the Internet (by virtue of the constant connection to the Internet), while unintentionally lessening the burdens on the electronic musical instrument.

EXAMPLE 4

Figure 8:
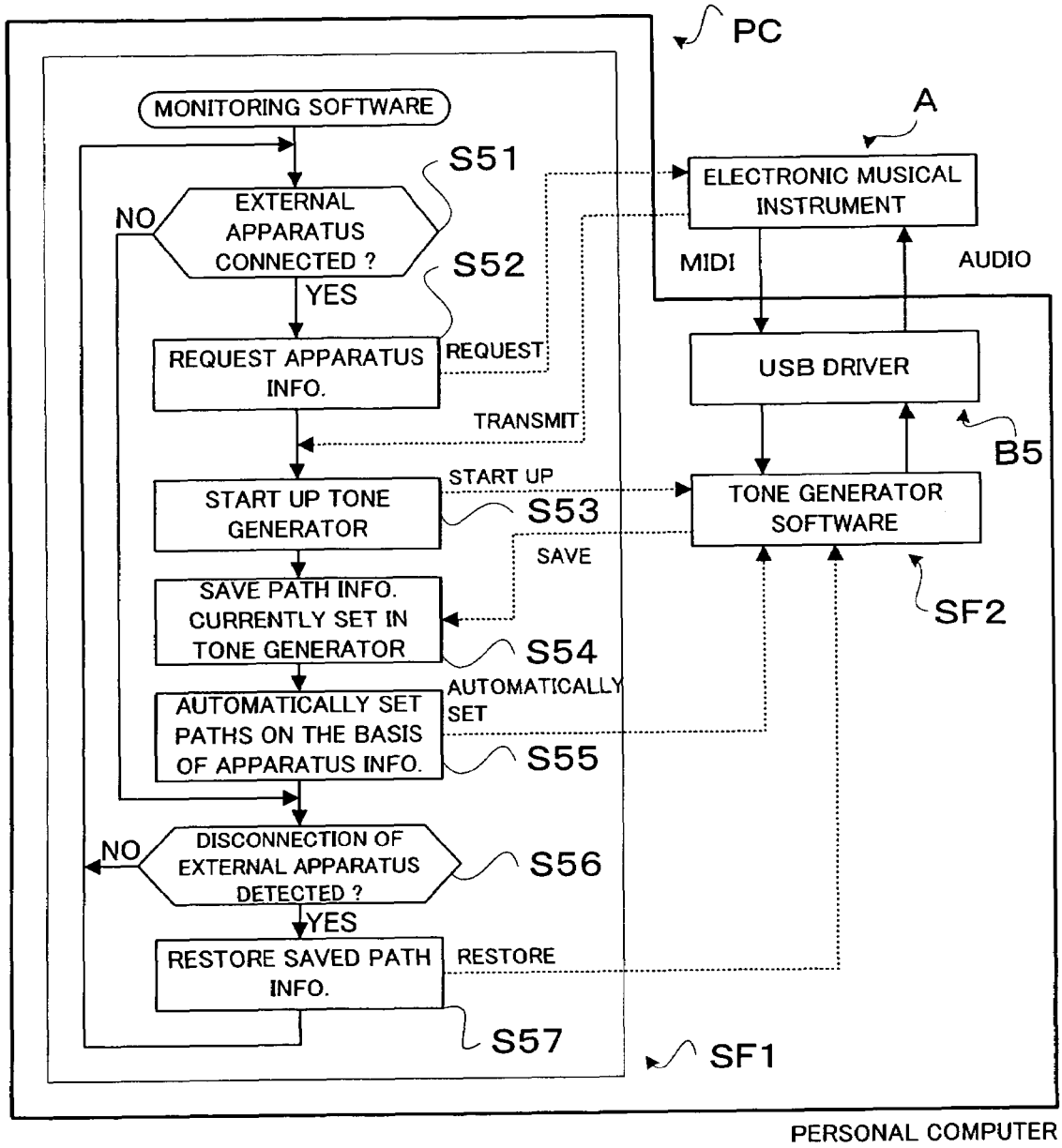
FIG. 8 is a control block diagram showing an embodiment of an electronic musical instrument system where a tone generator apparatus is implemented through software processing by a computer.

Next, a description will be given about an embodiment where a tone generator apparatus is implemented through software processing by a computer, with reference to FIG. 8. FIG. 8 is a control block diagram showing an embodiment of an electronic musical instrument system where a tone generator apparatus is implemented through software processing by a computer. In the instant embodiment, as seen from FIG. 8, a personal computer PC is allowed to function as a tone generator apparatus through operation of tone generator software SF2 installed in the personal computer PC. In the personal computer PC, the tone generator software SF2 does not always operate, but is started to operate in response to a start instruction from monitoring software SF1 that is a resident software program.

The monitoring software SF1 detects, at step S51, whether any external apparatus (in this case, the electronic musical instrument A) has been connected to any one of a plurality of communication interfaces (only a USB interface or USB driver unit B5 is shown in FIG. 8) provided in the personal computer PC. If it has been detected that the electronic musical instrument A has been newly connected, as an external apparatus, to any one of the communication interfaces (YES determination at step S51), monitoring software SF1 requests the connected electronic musical instrument A to transmit apparatus information of the musical instrument A, at step S52. Upon receipt, from the personal computer PC, the request for the apparatus information, the electronic musical instrument A transmits the requested apparatus information (such as the manufacturer's name, product name, model number, etc. of the electronic musical instrument A) to the personal computer PC. Then, the monitoring software SF1 automatically starts up the tone generator software SF2 or performs control for assisting the tone generator software SF2 with its startup, at step S53. As one example way to assist the tone generator software SF2 with its startup, a screen for prompting the startup of the tone generator software SF2 may be displayed on the display of the personal computer so that the tone generator software SF2 can be started up in response to an instruction given from the personal computer PC based on predetermined operation by the user having viewed the displayed screen.

Once the tone generator software SF2 has been started up, the monitoring software SF1 acquires, from the tone generator software SF2, information (signal path information) concerning signal input and output paths to and from the external apparatus, currently set in the tone generator software SF2, and saves the acquired signal path information in a predetermined storage area, at step S54. At step S55, the monitoring software SF1 automatically sets signal input and output paths corresponding to the electronic musical instrument A newly connected, as an external apparatus, to the personal computer PC. At step S56, a determination is made as to whether the electronic musical instrument A connected, as an external apparatus, to the personal computer PC has been disconnected from the personal computer PC. If the electronic musical instrument A has been disconnected from the personal computer PC (YES determination at step S56), the path information saved in the predetermined storage area is transmitted to the tone generator software SF2, and control is performed to restore the information concerning the signal input and output paths to states immediately before the electronic musical instrument A was connected to the personal computer PC, at step S57. In this way, it is possible to set dedicated signal input output paths corresponding to the electronic musical instrument A only while the electronic musical instrument A is being connected to the personal computer PC. Thus, even where some other external apparatus or the like than the electronic musical instrument A is connected and used with the personal computer PC functioning as a tone generator, it is not necessary to re-set signal input and output paths each time the other external apparatus is connected to the personal computer PC.

Note that the monitoring software SF1 performing the above-described operations may be a dedicated program or a program having a function to cause a tone generator driver to perform the above-described operations.

The above-described operation for saving the path information set in the tone generator software SF2 immediately before connection, to the personal computer PC, of some new external apparatus, operation for restoring the path information and operation for automatically setting path information corresponding to the newly-connected external apparatus may be performed by the tone generator software SF2, rather than by the monitoring software SF1. Further, the monitoring software SF1 may perform control to automatically terminate the tone generator software SF2 as the external apparatus is disconnected (see step S56 of FIG. 8).

What is claimed is:

1. An electronic musical instrument connectable with an external apparatus for communication therewith, the external apparatus being capable of establishing a plurality of input/output paths between the external apparatus and another apparatus, said electronic musical instrument comprising:

a performance operation section that generates a tone generation control signal in response to performance operation;

a sound output device that outputs an audible sound in accordance with a given sound signal;

a communication interface capable of bidirectionally communicating one or more types of signals via a common communication path in accordance with a common communication standard; and a control section that performs control to transmit the tone generation control signal, generated by said performance operation section, to the external apparatus via said communication interface and receive a sound signal from the external apparatus via said communication interface, the received sound signal being delivered to said sound output device, wherein, when the external apparatus has been connected to said electronic musical instrument via said communication interface, said control section transmits, to the external apparatus, predetermined information for setting signal input/output paths in the external apparatus and wherein said external apparatus includes a tone generator section that generates a sound signal of a tone indicated by the tone generation control signal, and wherein said external apparatus generates, by means of said tone generator section, a sound signal corresponding to the tone generation control signal given from said electronic musical instrument via said communication interface.

2. An electronic musical instrument as claimed in claim 1 wherein said tone generation control signal is encoded digital performance data including information indicative of a note of a tone to be generated, and said sound signal is digital waveform data of a sound to be generated.

3. An electronic musical instrument as claimed in claim 1 wherein said communication interface is a USB interface, and said electronic musical instrument is connected to the external apparatus via a removable USB cable.

4. An electronic musical instrument as claimed in claim 1 which further comprises:

an internal tone generator section that generates a sound signal of a tone indicated by the tone generation control signal; and a switching section that performs switching as to whether or not to generate a sound signal using said internal tone generator section and switching as to whether or not to generate a sound signal using said tone generator section of said external tone generator apparatus.

5. An electronic musical instrument as claimed in claim 1 wherein said predetermined information is apparatus information of said electronic musical instrument.

6. A tone generator apparatus connectable with a plurality of external apparatuses for communication therewith, said tone generator apparatus being capable of establishing a plurality of input/output paths between said tone generator apparatus and another apparatus, said tone generator apparatus comprising:

a tone generator section that generates a sound signal of a tone indicated by a tone generation control signal;

a communication interface capable of bidirectionally communicating one or more types of signals via a common communication path in accordance with a common communication standard;

a setting section that, when a given external apparatus has been connected to said tone generator apparatus via said communication interface, receives, from the given external apparatus, predetermined information for selling signal input/output paths in said tone generator apparatus and then automatically sets input and output paths between said tone generator section and said communication interface in accordance with the received predetermined information; and a control section that, in accordance with settings by said selling section, performs control to receive a tone generation control signal from the external apparatus via said communication interface and transmit the sound signal, generated by said tone generator section, to the external apparatus, the received tone generation control signal being delivered to said tone generator section, wherein said external apparatus is an electronic musical instrument, and wherein said control section receives, via said communication interface, a tone generation control signal, output from the electronic musical instrument in response to performance operation on the electronic musical instrument, to thereby input the received tone generation control signal to said tone generator section and transmits a sound signal, generated by said tone generator section in accordance with the tone generation control signal, to the electronic musical instrument via said communication interface.

7. A tone generator apparatus as claimed in claim 6 wherein said tone generation control signal is encoded digital performance data including information indicative of a note of a tone to be generated, and said sound signal is digital waveform data of a sound to be generated.

8. A tone generator apparatus as claimed in claim 6 wherein said communication interface is a USB interface, and said electronic musical instrument is connected to the external apparatus via a removable USB cable.

9. A tone generator apparatus as claimed in claim 6 wherein said predetermined information is apparatus information of said electronic musical instrument.

10. A tone generator apparatus as claimed in claim 6 which further comprises:

a storage section that stores tone generation control signals in accordance with a performance sequence of a music piece; and an automatic performance section that reproduces, in accordance with the performance sequence, the tone generation control signals stored in said storage section, wherein said tone generator section receives the tone generation control signals reproduced by said automatic performance section and generates sound signals corresponding to the received tone generation control signals.

11. A tone generator apparatus as claimed in claim 6 which further comprises an activation control section that detects whether the external apparatus has been connected to said tone generator apparatus via said communication interface and then automatically activates said tone generator section in accordance with the detection as to whether the external apparatus has been connected to said tone generator apparatus.

12. A tone generator apparatus as claimed in claim 6 which further comprises a restoration control section that, when the external apparatus has been connected to said tone generator apparatus via said communication interface, stores information indicative of signal input and output paths currently set with respect to said tone generator section, and that, when the external apparatus connected to said tone generator apparatus via said communication interface has been disconnected from said tone generator apparatus, restores previous settings of the signal input and output paths to and from said tone generator section on the basis of the stored information.

13. A storage medium storing a program for causing a processor, provided in an electronic musical instrument, to perform a procedure, said electronic musical instrument being connectable with an external apparatus for communication therewith, the external apparatus being capable of establishing a plurality of input/output paths between the external apparatus and another apparatus, said electronic musical instrument including: a performance operation section that generates a tone generation control signal in response to performance operation; a sound output device that outputs an audible sound in accordance with a given sound signal; and a communication interface capable of bidirectionally communicating one or more types of signals via a common communication path in accordance with a common communication standard, said procedure comprising:

a step of performing control to transmit the tone generation control signal, generated by said performance operation section, to an external apparatus via said communication interface and receive a sound signal from the external apparatus via said communication interface, the received sound signal being delivered to said sound output device; and a step of, when the external apparatus has been connected to said electronic musical instrument via said communication interface, transmitting, to the external apparatus, predetermined information for setting signal input/output paths in the external apparatus, wherein said external apparatus includes a tone generator section that generates a sound signal of a tone indicated by the tone generation control signal, and wherein said external apparatus generates, by means of said tone generator section, a sound signal corresponding to the tone generation control signal given from said electronic musical instrument via said communication interface.

14. A storage medium storing a program for causing a processor, provided in a tone generator apparatus, to perform a procedure, said tone generator apparatus connectable with a plurality of external apparatuses for communication therewith, said tone generator apparatus being capable of establishing a plurality of input/output paths between said tone generator apparatus and another apparatus, said tone generator apparatus including: a tone generator section that generates a sound signal of a tone indicated by a tone generation control signal; and a communication interface capable of bidirectionally communicating one or more types of signals via a common communication path in accordance with a common communication standard, said procedure comprising:

a setting step of, when a given external apparatus has been connected to said tone generator apparatus via said communication interface, receiving, from the given external apparatus, predetermined information for setting signal input/output paths in said tone generator apparatus and then automatically setting input and output paths between said tone generator section and said communication interface in accordance with the received predetermined information; and a step of, in accordance with settings by said setting step, performing control to receive a tone generation control signal from the external apparatus via said communication interface and transmit the sound signal, generated by said tone generator section, to the external apparatus, the received tone generation control signal being delivered to said tone generator section, wherein said external apparatus is an electronic musical instrument, and wherein said step of performing control receives, via said communication interface, a tone generation control signal, output from the electronic musical instrument in response to performance operation on the electronic musical instrument, to thereby input the received tone generation control signal to said tone generator section and transmits a sound signal, generated by said tone generator section in accordance with the tone generation control signal, to the electronic musical instrument via said communication interface.

* * * * *